US011892256B2

(12) United States Patent
Maga

(10) Patent No.: US 11,892,256 B2
(45) Date of Patent: Feb. 6, 2024

(54) AMMUNITION MAGAZINE WITH SELF-LOCKING MECHANISM

(71) Applicant: David Maga, Castaic, CA (US)

(72) Inventor: David Maga, Castaic, CA (US)

( * ) Notice: Subject to any disclaimer, the term of this patent is extended or adjusted under 35 U.S.C. 154(b) by 0 days.

(21) Appl. No.: 17/677,673

(22) Filed: Feb. 22, 2022

(65) Prior Publication Data

US 2023/0266086 A1 Aug. 24, 2023

(51) Int. Cl.
*F41A 17/38* (2006.01)
*F41A 9/67* (2006.01)

(52) U.S. Cl.
CPC ..... *F41A 17/38* (2013.01); *F41A 9/67* (2013.01)

(58) Field of Classification Search
CPC .. F41A 17/38; F41A 17/36; F41A 9/65; F41A 9/61; F41A 3/66
USPC ..... 42/50, 6, 49.01, 18
See application file for complete search history.

(56) References Cited

U.S. PATENT DOCUMENTS 4,194,433 A * 3/1980 Zellweger ..... F41A 3/66 89/190
4,726,136 A * 2/1988 Dornaus ..... F41A 17/64 42/70.08
5,685,101 A * 11/1997 Ferretti ..... F41A 9/65 89/34
5,806,224 A * 9/1998 Hager ..... F41A 17/38 42/50
7,941,955 B2 * 5/2011 Stone ..... F41A 9/65 42/50
8,756,845 B2 * 6/2014 Harris ..... F41A 3/66 42/16
8,898,946 B1 * 12/2014 Johnson ..... F41A 9/71 42/49.02
8,904,694 B1 * 12/2014 Afuh, II ..... F41A 35/02 42/96
9,010,004 B1 * 4/2015 Fu ..... F41A 17/38 42/6
9,091,499 B2 * 7/2015 Overstreet ..... F41A 9/70
9,341,421 B2 * 5/2016 Findlay ..... F41A 3/58
9,417,020 B2 * 8/2016 McGinty ..... F41A 17/38
9,482,478 B2 * 11/2016 Newman ..... F41A 3/66
9,593,897 B2 * 3/2017 Larson, Jr. ..... F41A 9/55
10,030,923 B1 * 7/2018 Loveday, IV ..... F41A 9/70
10,094,630 B1 * 10/2018 Loveday, IV ..... F41A 9/65
10,288,371 B2 * 5/2019 Maga ..... F41A 9/67
10,295,288 B2 * 5/2019 Maga ..... F41A 17/38
10,302,383 B2 * 5/2019 Maga ..... F41A 9/70
10,598,457 B2 * 3/2020 Maga ..... F41A 17/38
10,895,427 B2 * 1/2021 Maga ..... F41A 17/38
2004/0020092 A1 * 2/2004 Christensen ..... F41A 9/61 42/49.01
2009/0019757 A1 * 1/2009 Moretti ..... F41A 3/66 42/75.03
2010/0281737 A1 * 11/2010 Cahill ..... F41A 9/70 42/50
2011/0067226 A1 * 3/2011 Westbrook ..... F41A 35/00 29/283
2012/0260791 A1 * 10/2012 Kerbrat ..... F41A 3/72 89/1.4

(Continued)

*Primary Examiner* — Michael D David
(74) *Attorney, Agent, or Firm* — Roland J. Tong

(57) ABSTRACT

An ammunition magazine includes a self-locking mechanism configured to prevent the magazine from being removed from a firearm without disassembly of the firearm action.

14 Claims, 5 Drawing Sheets

(56) References Cited

U.S. PATENT DOCUMENTS

| | | | | |
|---|---|---|---|---|
| 2014/0223790 | A1* | 8/2014 | Wilson | F41A 9/65 42/49.01 |
| 2014/0230298 | A1* | 8/2014 | King, Jr. | F41A 3/66 42/16 |
| 2014/0317980 | A1* | 10/2014 | Michel | F41A 3/66 42/84 |
| 2015/0052793 | A1* | 2/2015 | Cassady | F41A 17/38 42/8 |
| 2015/0082678 | A1* | 3/2015 | Jacobson | F41A 17/38 42/8 |
| 2015/0345885 | A1* | 12/2015 | Brown | F41A 17/38 29/525.08 |
| 2016/0116250 | A1* | 4/2016 | Mather | F41A 3/66 42/73 |
| 2016/0169601 | A1* | 6/2016 | Newman | F41A 3/66 42/6 |
| 2016/0258697 | A1* | 9/2016 | Hoon | F41A 17/38 |
| 2016/0273857 | A1* | 9/2016 | Pettit | F41A 3/66 |
| 2016/0298918 | A1* | 10/2016 | Baker | F41A 11/02 |
| 2016/0334177 | A1* | 11/2016 | Green | F41A 3/66 |
| 2017/0299292 | A1* | 10/2017 | Daley, Jr. | F41A 3/66 |
| 2018/0292153 | A1* | 10/2018 | Maga | F41A 9/67 |
| 2018/0292154 | A1* | 10/2018 | Maga | F41A 17/38 |
| 2018/0292155 | A1* | 10/2018 | Maga | F41A 9/67 |
| 2018/0292156 | A1* | 10/2018 | Maga | F41A 17/38 |
| 2019/0219348 | A1* | 7/2019 | Maga | F41A 17/38 |
| 2019/0219352 | A1* | 7/2019 | Maga | F41A 9/67 |
| 2020/0025477 | A1* | 1/2020 | Williams | F41A 3/66 |

* cited by examiner

AMMUNITION MAGAZINE WITH SELF-LOCKING MECHANISM

TECHNICAL FIELD

The present disclosure relates in general to firearms, more particularly, to an ammunition magazine having a self-locking mechanism for securing the magazine within a firearm.

BACKGROUND

Concern over mass shootings in America has led some U.S. states such as California and New York to ban the use of "assault-style" weapons. The definition of "assault style" weapons varies from state-to-state, but in California AR-15-type sporting rifles with detachable magazines fall under this umbrella. Specifically, current California law requires that all semi-automatic rifles using centerfire ammunition must be at least 30" in length and must have fixed magazines that hold no more than 10 rounds, where a "fixed magazine" is defined as a magazine that cannot be removed without disassembling the firearm action.

In response to this legislation, innovators have devised numerous ways of bringing non-compliant sporting rifles into compliance with the laws of California and other states. For example, U.S. Pat. Nos. 10,598,457B2, 10,859,335B2, 10,895,427B2, 10,302,383B2, 10,288,371B2, and 10,295,288B2, all to Maga, disclose various affixable magazines that allow loading of ammunition without removing the magazine from the firearm or disassembling the action. Each of the magazines disclosed in these patents must be manually locked into place in the magazine well by turning a screw. While the manually locking mechanisms are adequate for their purposes, there is still room for improvement in affixable magazines for previously non-compliant firearms.

SUMMARY

The present disclosure relates to an ammunition magazine including a self-locking mechanism configured to prevent the magazine from being removed from a firearm without disassembly of the firearm action.

In one aspect of the disclosure, the self-locking mechanism is configured to lock the magazine to the firearm without the use of tools.

In another aspect of the disclosure, the self-locking mechanism is configured to be actuated by downward movement of the magazine relative to the firearm, with no additional actions by the user.

In still another aspect of the disclosure, the self-locking mechanism includes a locking member mounted for movement between a first position wherein the locking member projects beyond the side wall of the magazine and engages a portion of the firearm, and a second position wherein the locking member is retracted from the side wall of the magazine and disengaged from the portion of the firearm. In another aspect, the second position is below the first position.

In yet another aspect of the disclosure, the locking mechanism includes a spring biasing the locking member towards the first position.

In another aspect of the disclosure, the locking mechanism is a wheel.

In still another aspect of the disclosure, the wheel and the spring are mounted in a recessed area in the magazine. The recessed area includes a wheel-containing portion and a spring-containing portion. The wheel-containing portion contains a top wall defining an upper boundary for the wheel, a bottom wall defining a lower boundary for the wheel, a side wall extending between the top and bottom walls, and an opening opposite the side wall of the recessed area, allowing a portion of the wheel to project past the side wall of the magazine when the wheel is in the first position. The spring-containing portion extends below the bottom wall of the wheel-containing portion.

In yet another aspect of the disclosure, the wheel includes disc having a protruding hub, and the recessed area includes a slot receiving the protruding hub.

In another aspect of the disclosure, the spring-containing portion comprises a portion of the slot extending below the bottom wall of the wheel-containing portion.

In still another aspect of the disclosure, the ammunition magazine includes a bore extending between a top wall of the magazine and a top wall of the wheel-containing portion. The bore allows insertion of a tool for pushing the wheel toward the second position to unlock the magazine.

BRIEF DESCRIPTION OF THE DRAWINGS

The disclosure will be more fully understood from the following detailed description, in conjunction with the following figures, wherein.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
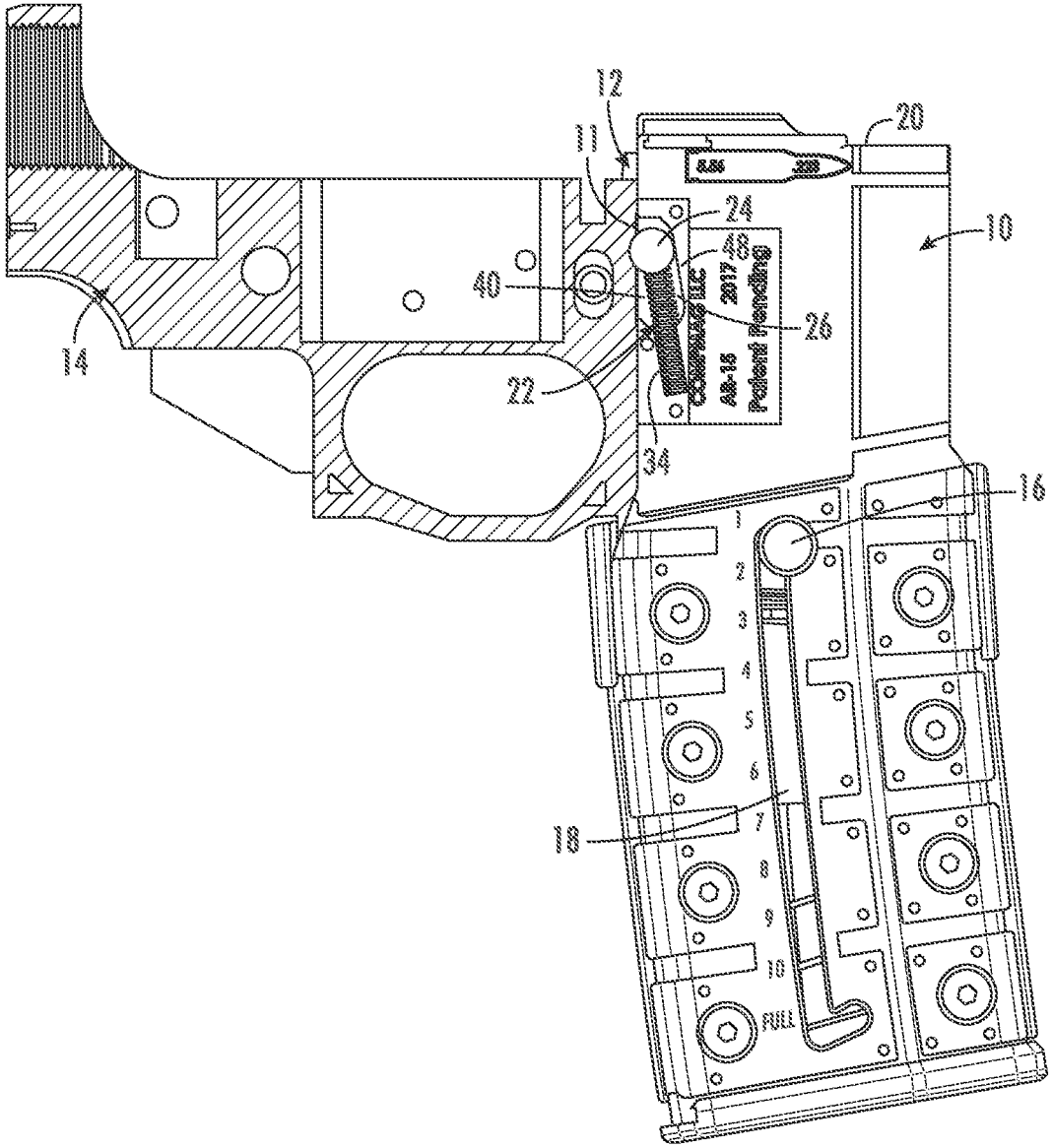
FIG. 1 is a front view, partially in section, showing an ammunition magazine in the lower receiver of a sporting rifle, with the cover of its locking mechanism removed.

FIG. 1 shows a side loadable ammunition magazine 10 secured to the inner wall 11 of a magazine well 12 in the lower receiver 14 of a sporting rifle such as an AR-15. The magazine 10 includes a spring-loaded follower assembly having a finger pull 16 located in a slot 18 on one side of the magazine 10. To load the magazine 10, a user pulls the finger pull 16 down the slot 18 and locks it in the down position, compressing the spring of the follower assembly and locking the cartridge follower in the down position. The user then feeds ammunition cartridges into an opening in the opposite side of the magazine 10 and releases the finger pull 16, causing the cartridge follower to push the cartridges up toward the open feeding end 20 of the magazine. The magazine 10 is secured within the magazine well 12 by a self-locking mechanism 22 that cannot be disengaged while the lower receiver 14 is covered by an upper receiver. The self-locking mechanism 22, which actuates automatically upon insertion of the magazine 10 into the well and does not require the use of any tools, need not be limited to use with the specific magazine and receiver illustrated shown here, but may be used to secure a variety of different types of magazines to various types of firearms. Examples of magazines that may a utilize a self-locking mechanism 22 include, but are not limited to, magazines having pivoting or sliding doors or other openings allowing loading of the magazine via locations other than the top, or even possibly conventional magazines that are loaded through the top.

Figure 3:
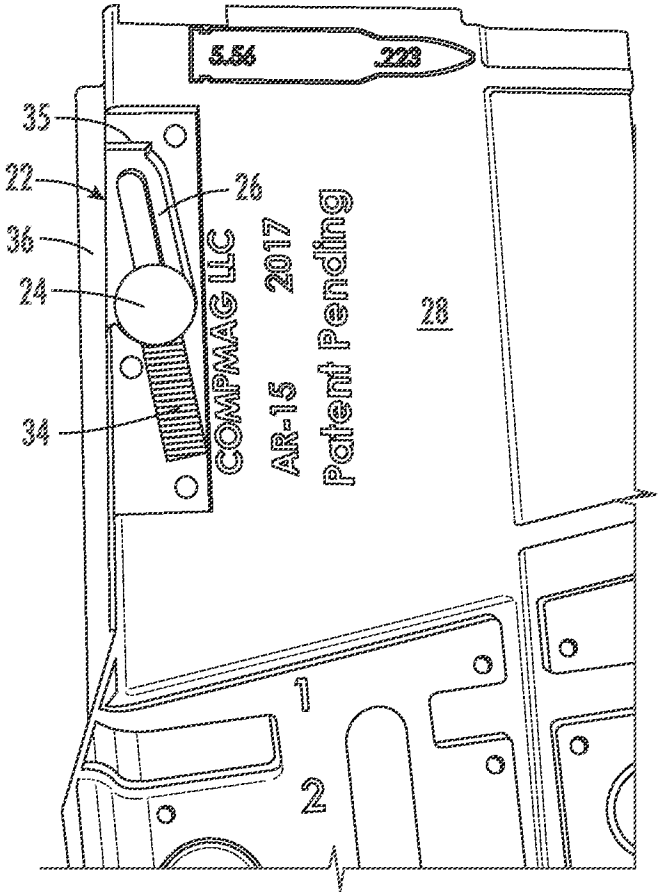
FIG. 3 is a view similar to FIG. 3, showing the locking mechanism in unlocked position.
Figure 2:
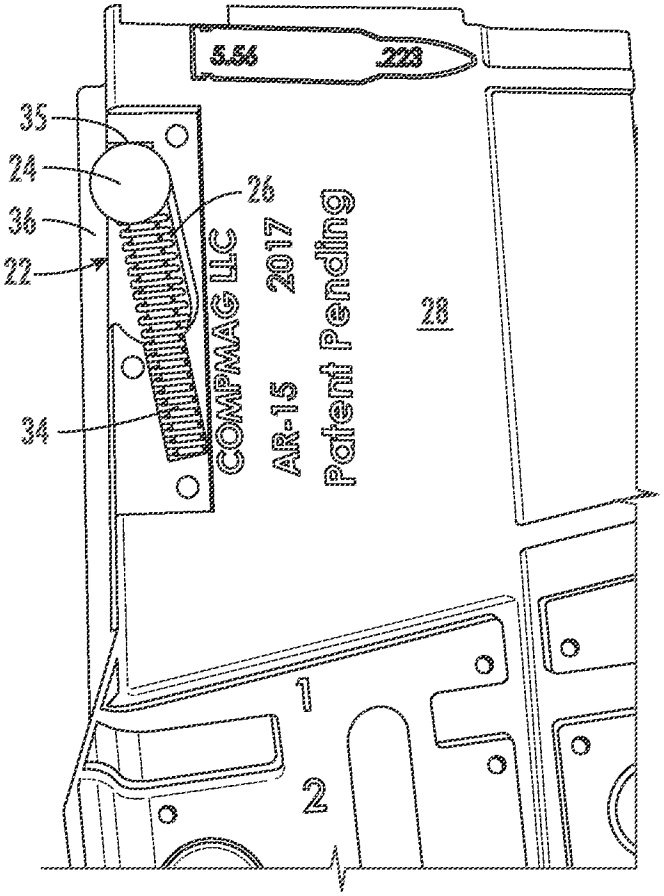
FIG. 2 is a fragmentary front view of the magazine of FIG. 1, with its locking mechanism in locked position.

Referring now to FIGS. 2 and 3, the automatic locking mechanism 22 comprises a locking wheel 24 disposed within a recessed area 26 in the upper portion 28 of the magazine. The locking wheel 24 is mounted for diagonal movement between opposite ends of the recessed area 26. A compression spring 34 biases the locking wheel 24 towards a locked position at the top wall 35 of the recessed area 26, wherein a portion of the locking wheel 24 projects laterally beyond the side wall 36 of the magazine, as shown in FIG. 2. After being pushed against the bias of the compression spring 34 to an unlocked position at the bottom end 32 of the recessed area 26, as shown in FIG. 3, the locking wheel 24 is entirely contained with the recessed area 26, and does not project beyond the side wall 36 of the magazine.

Figure 4:
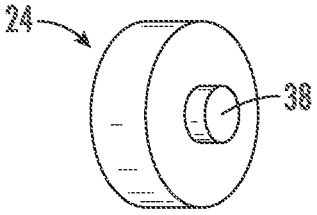
FIG. 4 is a perspective view of a locking wheel.
Figure 5:
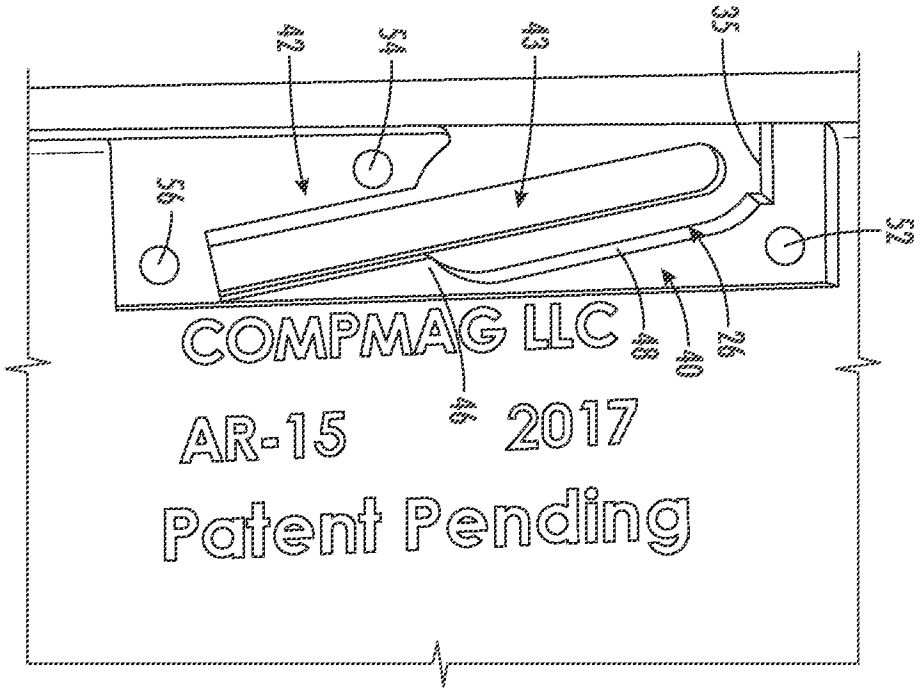
FIG. 5 is an enlarged, fragmentary front view showing the locking mechanism of FIGS. 2 and 3, with the locking wheel removed.

FIGS. 4 and 5 show the locking wheel 24 and recessed area 26 in greater detail. The locking wheel 24 comprises a metallic disc having a protruding hub 38 formed on one side. The recessed area 26 includes a wheel-containing portion 40 and a spring-containing portion 42, with a slot 43 extending diagonally through both portions 40, 42. The wheel-containing portion 40 includes the top wall 35, which defines an upper boundary for the wheel 24, a bottom wall 46 defining a lower boundary for the wheel 24, and a side wall 48 extending between the top and bottom walls 35, 46. The side of the recessed area 26 opposite the side wall 48 is open, allowing a portion of the wheel 24 to project past the side wall 36 of the magazine when the wheel 24 is in its uppermost position. The region of the slot 43 above the bottom wall 46 of the wheel-containing portion 40 serves as a channel slidably receiving the hub 38 of the wheel, while the region below the bottom wall 46 houses the spring.

Figure 6:
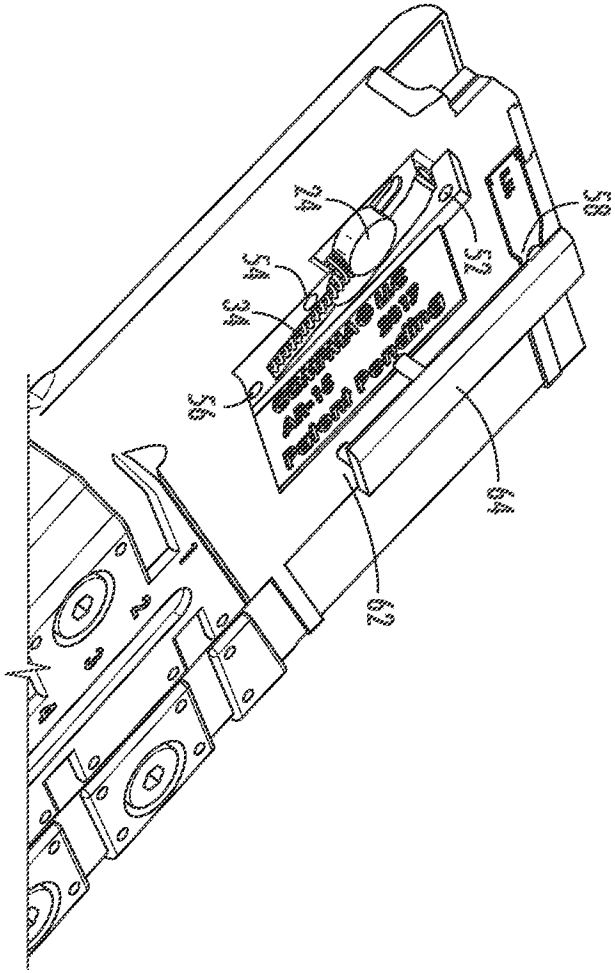
FIG. 6 is a fragmentary perspective view showing a locking mechanism cover in exploded relationship to the locking mechanism of FIGS. 2 and 3.

A plurality of openings 52, 54, 56 are provided around the recessed area 26 for receiving pins 58, 60, 62 depending from the underside of a cover 64, as shown in FIG. 6. The cover 64 holds the locking wheel 24 and spring 34 in place, while also protecting them from the elements. Its removability allows the components to easily be replaced if needed.

Figure 7:
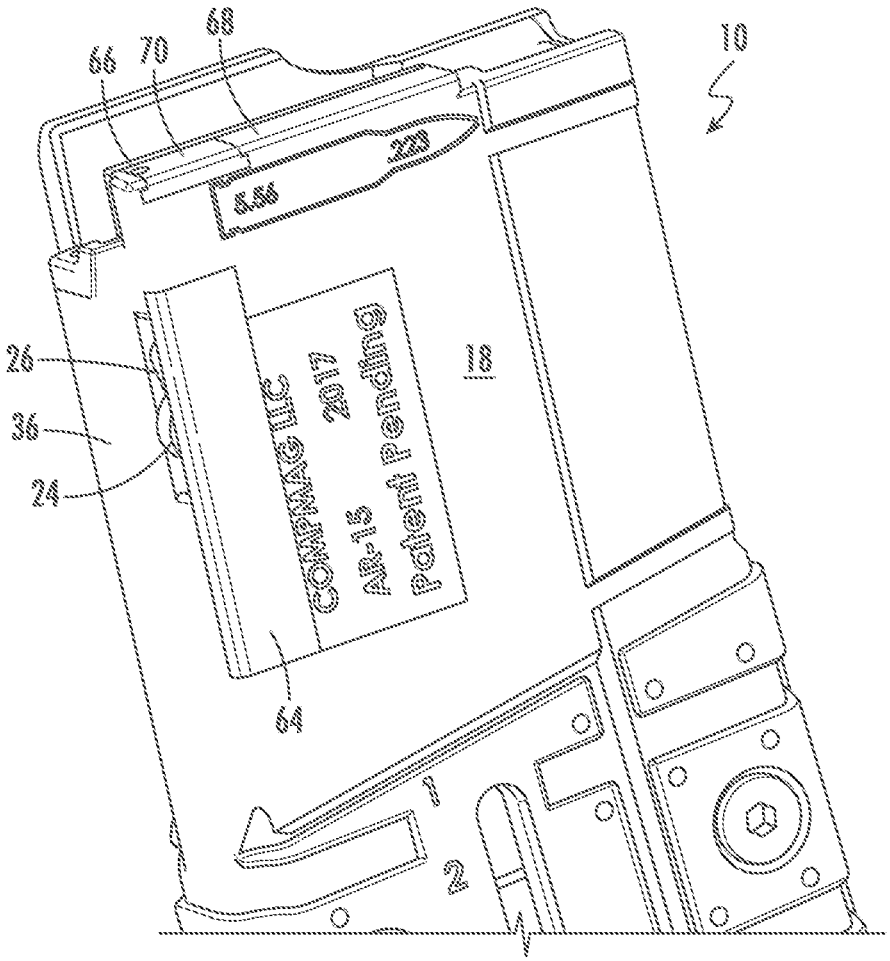
FIG. 7 is a fragmentary perspective view of the magazine of FIGS. 2 and 3, with the locking mechanism cover in place.

FIG. 7 shows the cover 64 in place on the upper portion 28 of the magazine 10, with the locking wheel 24 projecting out from the open side of the recessed area 26, past the side wall 36 of the magazine. Also visible in FIG. 7 is an end cap 70 having an indentation 66 that marks the location of a bore allowing a pushing tool to access the locking mechanism, as will be described later in reference to FIG. 8. The end cap 70 can not be removed without breaking the firearm action. In jurisdictions which require the magazine to be permanently affixed to the firearm, the end cap 70 can be epoxied in place so that access to the locking mechanism is permanently blocked.

Referring again to FIG. 1, to lock the magazine 10 into place, a user simply pushes the magazine 10 downwardly into the well 10. As the magazine 10 moves downwardly, the spring forces the wheel 10 upwardly against both the inner wall 11 of the magazine well 12 and the side wall 48 of the wheel-containing portion 40 of the recessed area 26. Continued downward movement of the magazine 10 and upward movement of the magazine well 12 causes the wheel to rotate upwardly into an area of decreasing size, increasing the tightness of the wheel and the strength of the lock.

As soon as one side of the locking wheel 24 contacts the inner wall 11 of the well 10, the inner wall 11 exerts an inward force on the wheel 24, causing the opposite side of the wheel 24 to contact the side wall 48 of the wheel-containing portion 40 of the recessed area 26. When the magazine 10 is fully seated in the well 12, the spring 34 forces the wheel 24 back upwardly, exerting a sufficiently strong outward force against the inner wall 11 of the well 12 to prevent removal of the magazine 10.

Figure 8:
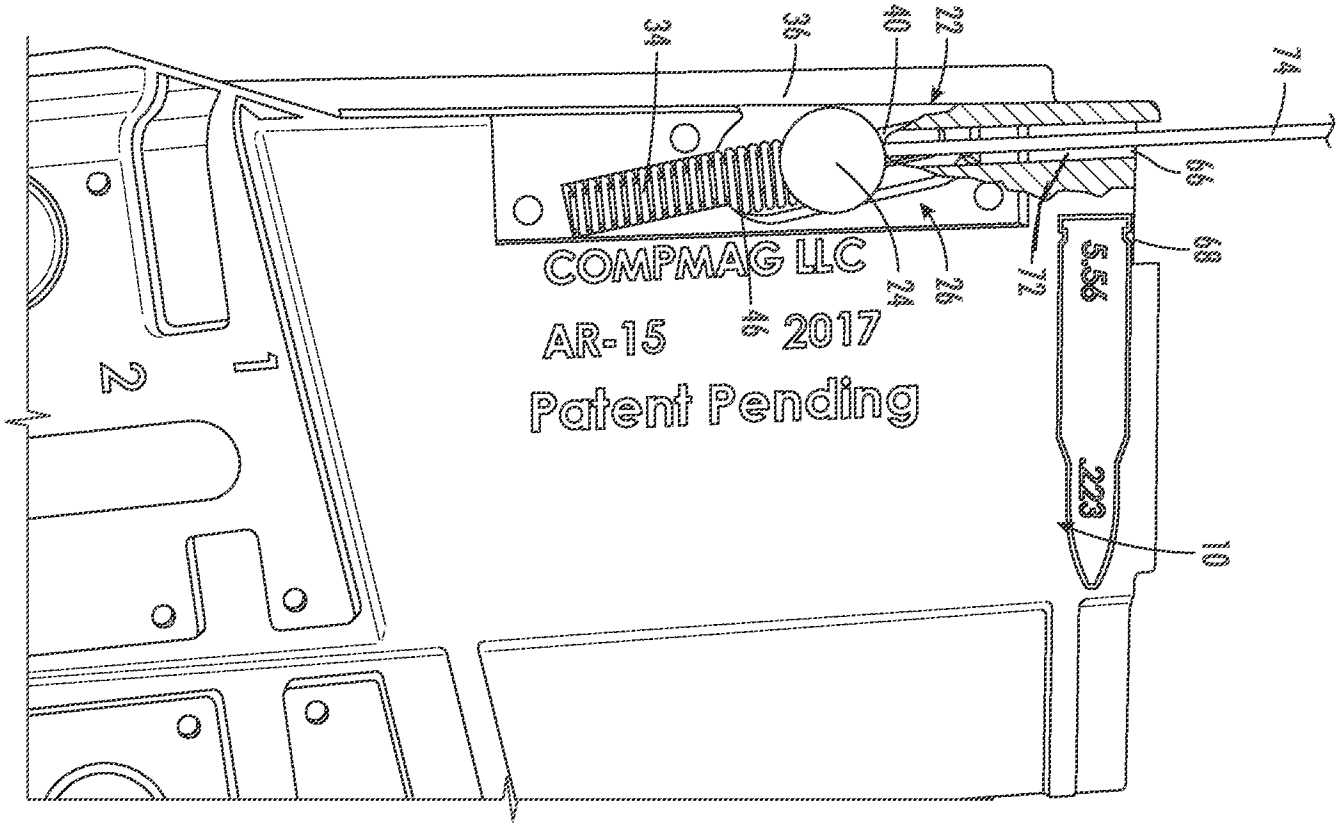
FIG. 8 is a fragmentary front view, partially in section, showing the locking mechanism of FIGS. 2 and 3 being moved towards its unlocked positions.

To remove the magazine 10 from the receiver, the user must insert a pushing tool such as a thin rod 74 into the opening 66 in the top wall 68 of the magazine 10, as shown in FIG. 8. The opening 66 leads to a bore 72 that extends into the recessed area 26 of the locking mechanism 22, allowing the rod 74 to contact the upper surface of the locking wheel 24. Continued downward force by the rod 74 forces the locking wheel 24 to move downwardly until it reaches the bottom wall 46 of the wheel-containing portion 40 of the recessed area 26, where it no longer projects beyond the side wall 36 of the magazine 10. In this position, the locking wheel 24 no longer exerts any force against the inner wall of the magazine well, thus allowing the user to remove the magazine. Since these steps cannot be carried out without disassembling the firearm action, the locking mechanism 22 enables the user to comply with the regulations of all or most jurisdictions regarding fixed magazines.

The illustrated locking mechanism 22 is just one example of a locking mechanism that could be in the self-locking magazine of this disclosure. Mechanisms including locking members other than wheels—such as, for instance, cammed levers or spring-actuated pins—would also self-actuate upon downward movement of the magazine, and are included within the scope of this disclosure.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An ammunition magazine for insertion into a firearm having a firing action, the magazine comprising;

a side wall; and a self-locking mechanism configured to prevent the magazine from being removed from the firearm without disassembly of the firing action, the self-locking mechanism including a locking member mounted for automatic movement between an unlocked position and a locked position in response to insertion of the magazine into the firearm;

wherein the locking member is spaced from the side wall of the magazine and disengaged from a portion of the firearm when in the unlocked position and projects laterally beyond the side wall of the magazine to engage a portion of the firearm when in the locked position.

2. An ammunition magazine according to claim 1, wherein the self-locking mechanism is configured to automatically lock the magazine to the firearm without the use of tools.

3. An ammunition magazine according to claim 1, wherein the self-locking mechanism is configured to be automatically actuated by vertical movement of the magazine relative to the firearm.

4. The ammunition magazine according to claim 1, wherein the unlocked position is below the locked position.

5. The ammunition magazine according to claim 1, further comprising a spring biasing the locking member towards the locked position.

6. The ammunition magazine according to claim 5, wherein the locking member is a wheel.

7. The ammunition magazine according to claim 6, wherein the wheel and the spring are mounted in a recessed area in the magazine, the recessed area comprising:

a wheel-containing portion including a top wall defining an upper boundary for the wheel, a bottom wall defining a lower boundary for the wheel, a side wall extending between the top and bottom walls, and an opening opposite the side wall of the recessed area, allowing a portion of the wheel to project past the side wall of the magazine when the wheel is in the locked position; and a spring-containing portion extending below the bottom wall of the wheel-containing portion.

8. The ammunition magazine according to claim 7, wherein:

the wheel includes a disk having a protruding hub; and the recessed area further includes a slot receiving the protruding hub of the wheel.

9. The ammunition magazine according to claim 8, wherein the slot extends diagonally inwardly and downwardly from the top wall of the wheel-containing portion.

10. The ammunition magazine according to claim 7, wherein the spring-containing portion comprises a portion of the slot extending below the bottom wall of the wheel-containing portion.

11. The ammunition magazine according to claim 7, wherein:

the magazine includes a top wall; and further comprising a bore extending between the top wall of the magazine and the top wall of the wheel-containing portion, the bore allowing insertion of a tool for pushing the wheel toward the second position.

12. An ammunition magazine for insertion into a firearm having a firing action, the magazine comprising;

a housing including a side wall, and a recessed area including an opening aligned with the side wall; and a self-locking mechanism configured to prevent removal of the magazine from the firearm without disassembly of the firing action, the self-locking mechanism including a locking member mounted for automatic movement between an unlocked position and a locked position in response to insertion of the magazine into the firearm;

wherein the locking member is entirely contained within the recessed area when in the unlocked position and projects laterally beyond the side wall when in the locked position.

13. The ammunition magazine according to claim 12, further comprising a spring biasing the locking member towards the locked position.

14. The ammunition magazine according to claim 12, wherein the locking member is a wheel.

* * * * *